US006260717B1

(12) United States Patent
Keller, Jr.

(10) Patent No.: US 6,260,717 B1
(45) Date of Patent: Jul. 17, 2001

(54) GOLF CLUB SUPPORT APPARATUS

(76) Inventor: Ralph L. Keller, Jr., 501 Lynn Ave., Antioch, CA (US) 94509

( * ) Notice: Subject to any disclaimer, the term of this patent is extended or adjusted under 35 U.S.C. 154(b) by 0 days.

(21) Appl. No.: 09/578,296

(22) Filed: May 25, 2000

(51) Int. Cl.[7] ..... A63B 55/00

(52) U.S. Cl. ..... 211/70.2; 211/85.7; 211/60.1; 248/533

(58) Field of Search ..... 211/70.2, 85.7, 211/60.1, 72; 473/282; 248/156, 530, 533

(56) References Cited

U.S. PATENT DOCUMENTS

| | | | | |
|---|---|---|---|---|
| 1,447,579 | * | 3/1923 | Thomas | 248/87 |
| 2,275,870 | * | 3/1942 | Sheldon | 211/85.7 |
| 3,408,075 | * | 10/1968 | Colton | 473/204 |
| 3,966,051 | | 6/1976 | Hollister et al. . | |
| 4,545,579 | * | 10/1985 | McCain | 473/282 |
| 4,940,201 | | 7/1990 | Kurth . | |
| 5,080,239 | | 1/1992 | Rowland . | |
| 5,127,530 | | 7/1992 | Ortuno . | |
| 5,417,334 | | 5/1995 | Wu . | |
| 5,467,980 | | 11/1995 | Weisenstein . | |
| 5,597,363 | | 1/1997 | Leote . | |
| 5,873,471 | | 2/1999 | Ruggeri . | |
| 5,884,881 | * | 3/1999 | Band et al. | 248/166 |

* cited by examiner

*Primary Examiner*—Gregory J. Strimbu
(74) *Attorney, Agent, or Firm*—Thomas R. Lampe

(57) ABSTRACT

A golf club support apparatus includes an elongated primary support member and a secondary support member pivotally attached to the primary support member. The secondary support member may be moved between two locations. In one location the secondary support member projects outwardly from the primary support member and defines a notch for holding golf club heads. In another location the secondary support member partially surrounds the primary support member and is parallel to the longitudinal axis of the primary support member. A removable end cap can be employed as an article holder.

11 Claims, 6 Drawing Sheets

GOLF CLUB SUPPORT APPARATUS

TECHNICAL FIELD

This invention relates to a support apparatus for supporting one or more golf clubs in a generally vertical condition. The golf club support apparatus is portable and is suitable for being carried with golf clubs in a golf bag.

BACKGROUND OF THE INVENTION

A number of devices are known in the prior art for supporting golf clubs in a generally vertical orientation so that the golfer has ready access to the clubs. A golfer may hand carry several clubs to the spot of a ball on a golf course and make a decision at that point as to which club he or she will use for the next shot. By employing a golf club support the clubs not used may be maintained in a general upright condition so that they will not be exposed to moisture and dirt which might very well be the case if the clubs were lying on the ground. Furthermore, using the support, the golfer need not bend over to retrieve the supported clubs. Also, clubs maintained in a generally upright condition by the support are less likely to be left behind.

The following United States patents are believed to be representative of the current state of the prior art in this area: U.S. Pat. No. 5,873,471, issued Feb. 23, 1999, U.S. Pat. No. 5,080,239, issued Jan. 14, 1992, U.S. Pat. No. 4,940,201, issued Jul. 10, 1990, U.S. Pat. No. 3,966,051, issued Jun. 29, 1976, U.S. Pat. No. 5,467,980, issued Nov. 21, 1995, U.S. Pat. No. 5,127,530, issued Jul. 7, 1992, U.S. Pat. No. 5,597,363, issued Jan. 28, 1997, and U.S. Pat. No. 5,417, 334, issued May 23, 1995.

The patents do not teach or suggest the arrangement disclosed and claimed herein.

DISCLOSURE OF INVENTION

The golf club support apparatus of the present invention is characterized by its relative simplicity, low cost and ease of use. A golfer can set up the support with one hand, leaving his or her other hand free to hold a club or clubs. The apparatus is highly portable and compact so that it readily fits into a golf bag compartment or tube or in an umbrella sleeve.

The golf club support apparatus includes a double-ended, elongated, rigid primary support member having an upper end, a ground engaging lower end, and a primary support member longitudinal axis extending between the upper end and the ground engaging lower end. The ground engaging lower end is for insertion into the ground to maintain the double-ended, elongated, rigid primary support member at a selected orientation relative to the ground and the upper end disposed above the ground.

The golf club support apparatus also includes a secondary support member pivotally attached to the double-ended, elongated, rigid primary support member and defining a secondary support member cavity. The secondary support member is selectively pivotally movable relative to the double-ended, elongated, rigid primary support member between a first location wherein the secondary support member is disposed substantially parallel to the primary support member longitudinal axis and the double-ended, elongated, rigid primary support member is positioned in the secondary support member cavity and a second location wherein the secondary support member projects outwardly away from the double-ended, elongated, rigid primary support member.

Other features, advantages, and objects of the present invention will become apparent with reference to the following description and accompanying drawings.

BEST MODE FOR CARRYING OUT THE INVENTION

Figure 1:
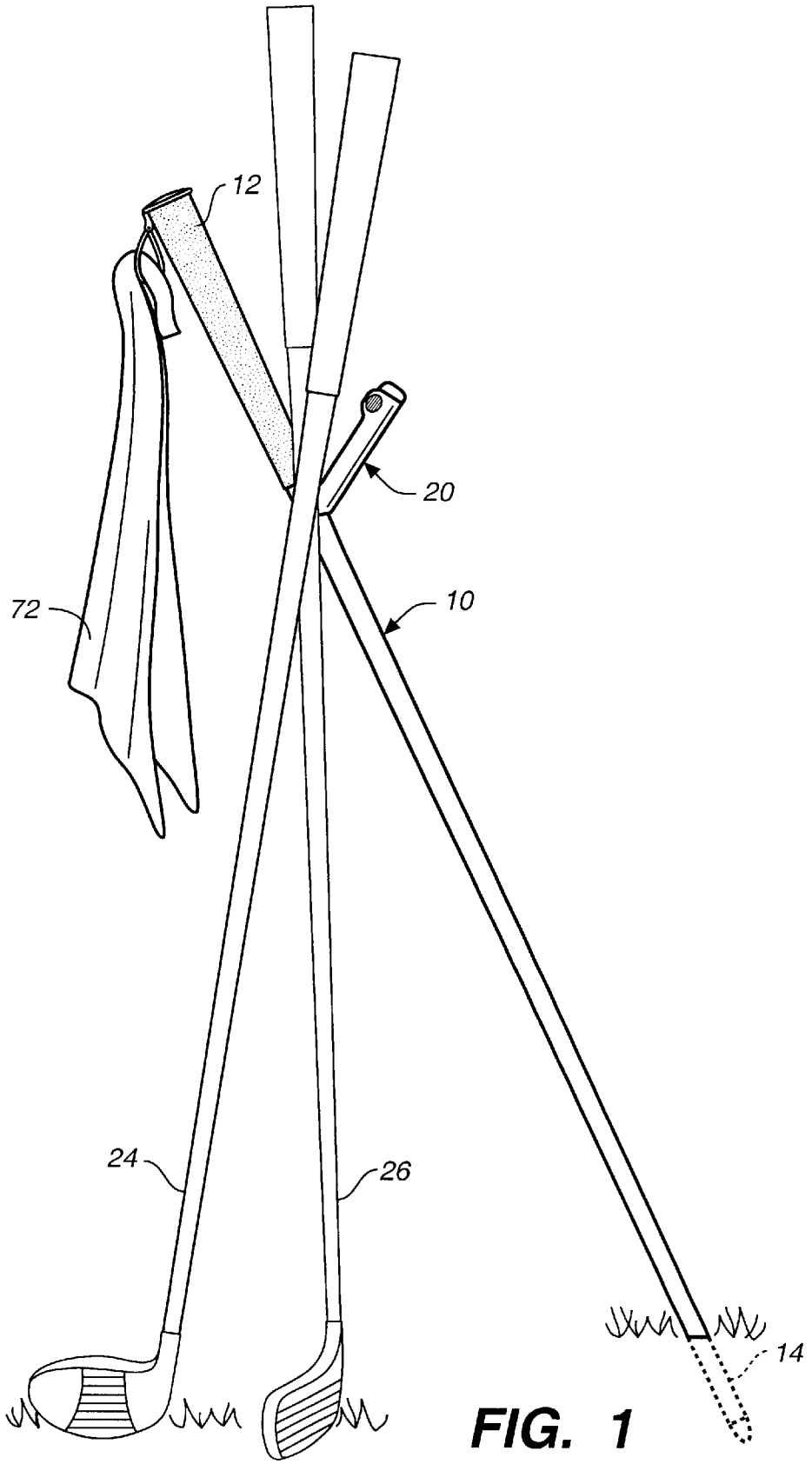
FIG. 1 is a perspective view illustrating the golf club support apparatus of the present invention extending upwardly from the ground and supporting two golf clubs to maintain the golf clubs in a generally vertical orientation.
Figure 3:
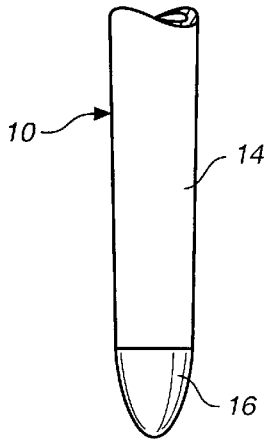
FIG. 3 is an elevational view illustrating the lower end of the primary support member.
Figure 4:
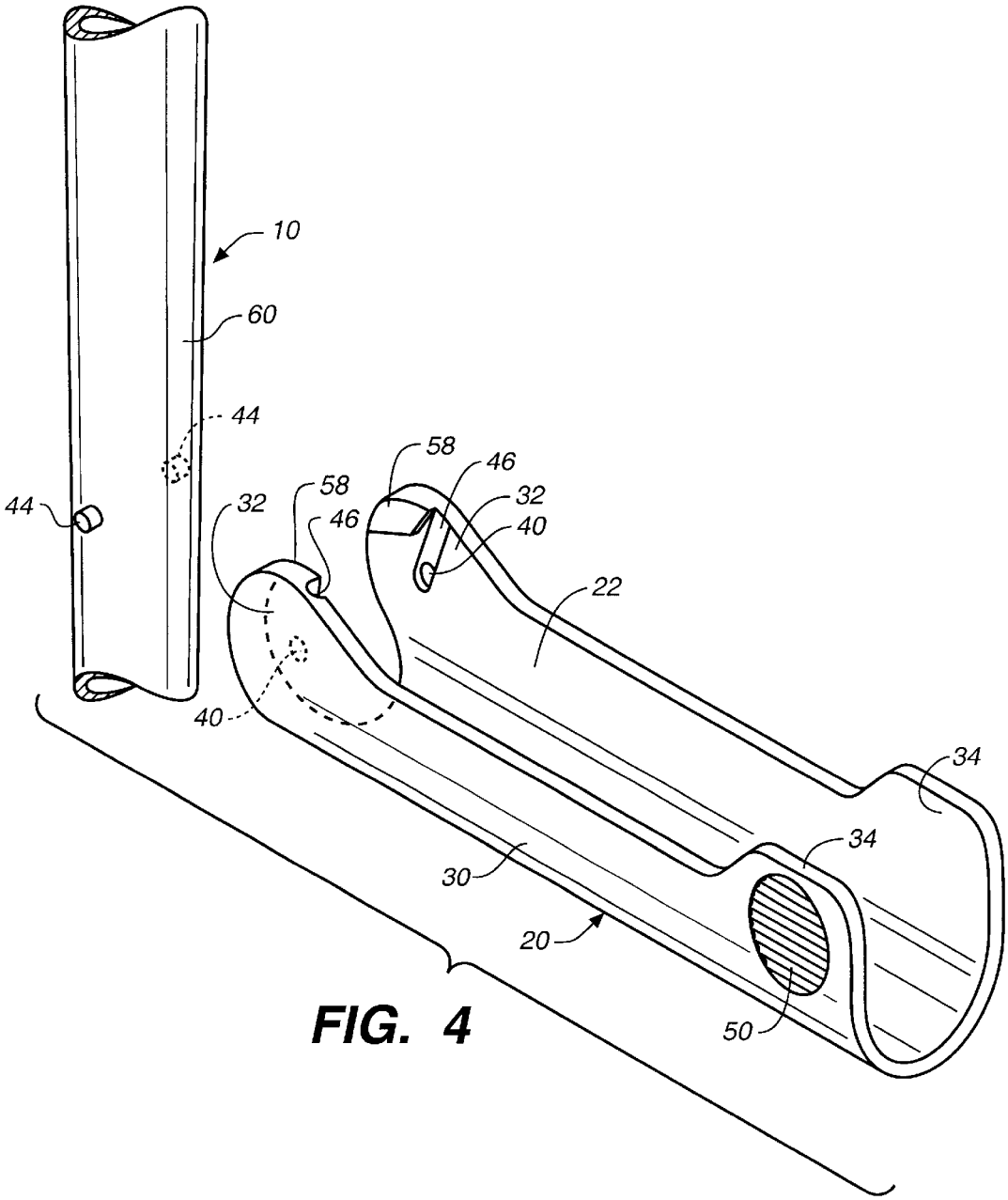
FIG. 4 is a perspective view illustrating the secondary support member prior to its attachment to a segment of the primary support member.

Referring now to the drawings, the golf club support apparatus of the present invention includes a double-ended, elongated, rigid primary support member 10 having an upper end 12 and a ground engaging lower end 14. FIG. 1 shows the primary support member lower end in the ground and the primary support member disposed at a selected orientation relative to the ground with the upper end 12 above the ground. The primary support member can have the general attributes and configuration of a standard golf club shaft with a standard rubber or other resilient golf club grip for economy of manufacture and ease of replacement of a worn or damaged grip. The resilient grip on the primary support member and the grips on the supported clubs will frictionally engage and make it less likely that the clubs will slide out of the support apparatus. However, as can perhaps best be seen with reference to FIG. 3, the lower end 14 is tapered at the lowermost extremity 16 thereof and rounded. This enables the golf club support apparatus to be readily positioned in the ground while lessening the possibility of damaging clubs, golf bags or other equipment which would be the case with a sharply pointed end or other end configuration having sharp corners or points.

The golf club support apparatus also includes a secondary support member 20 pivotally attached to the primary support member and defining a secondary support member cavity 22.

Figure 2A:
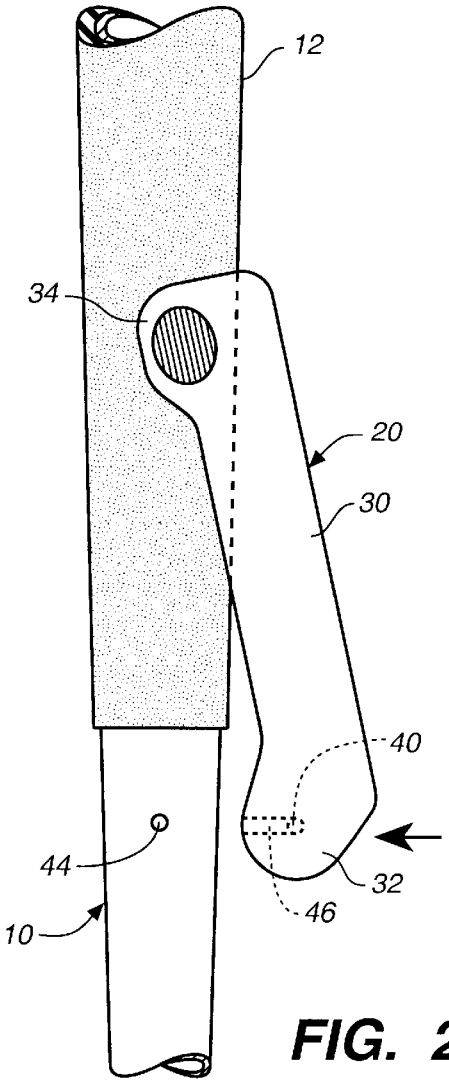
FIG. 2A is an enlarged, elevational view illustrating a portion of the primary support member of the invention having the secondary support member thereof being positioned into engagement therewith.
Figure 2B:
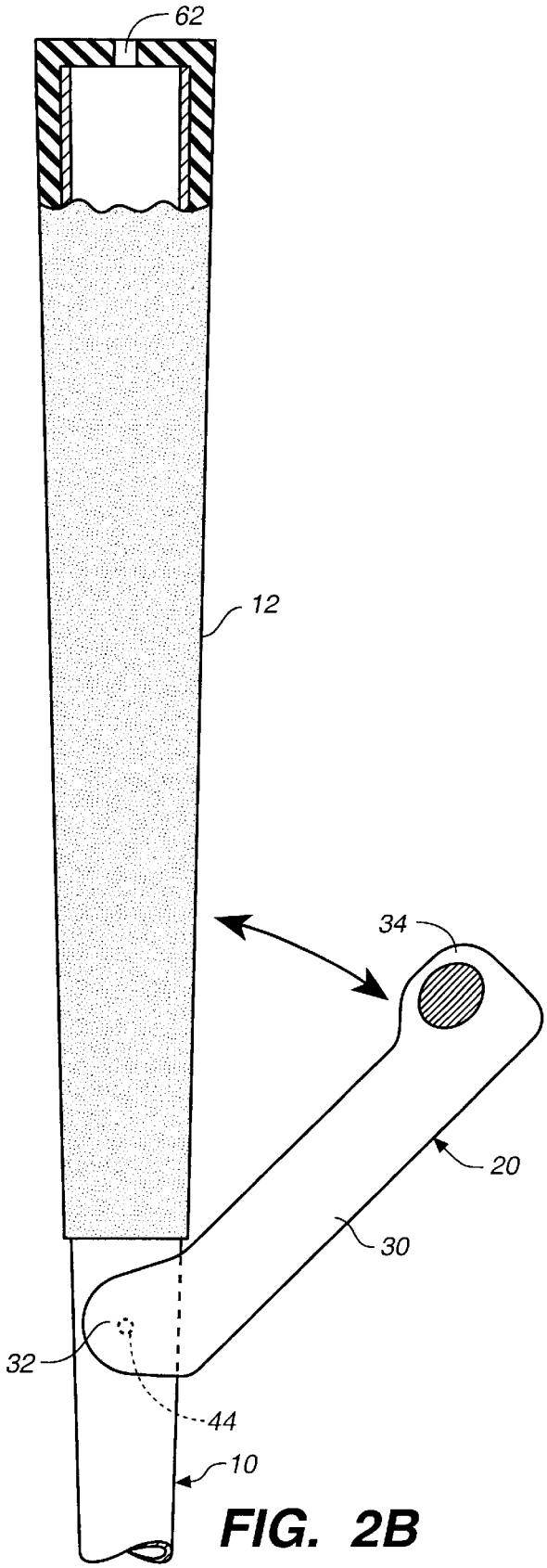
FIG. 2B is an enlarged, elevational view, in partial cross-section, illustrating the upper end of the primary support member and the secondary support member installed thereon and projecting outwardly therefrom.
Figure 5:
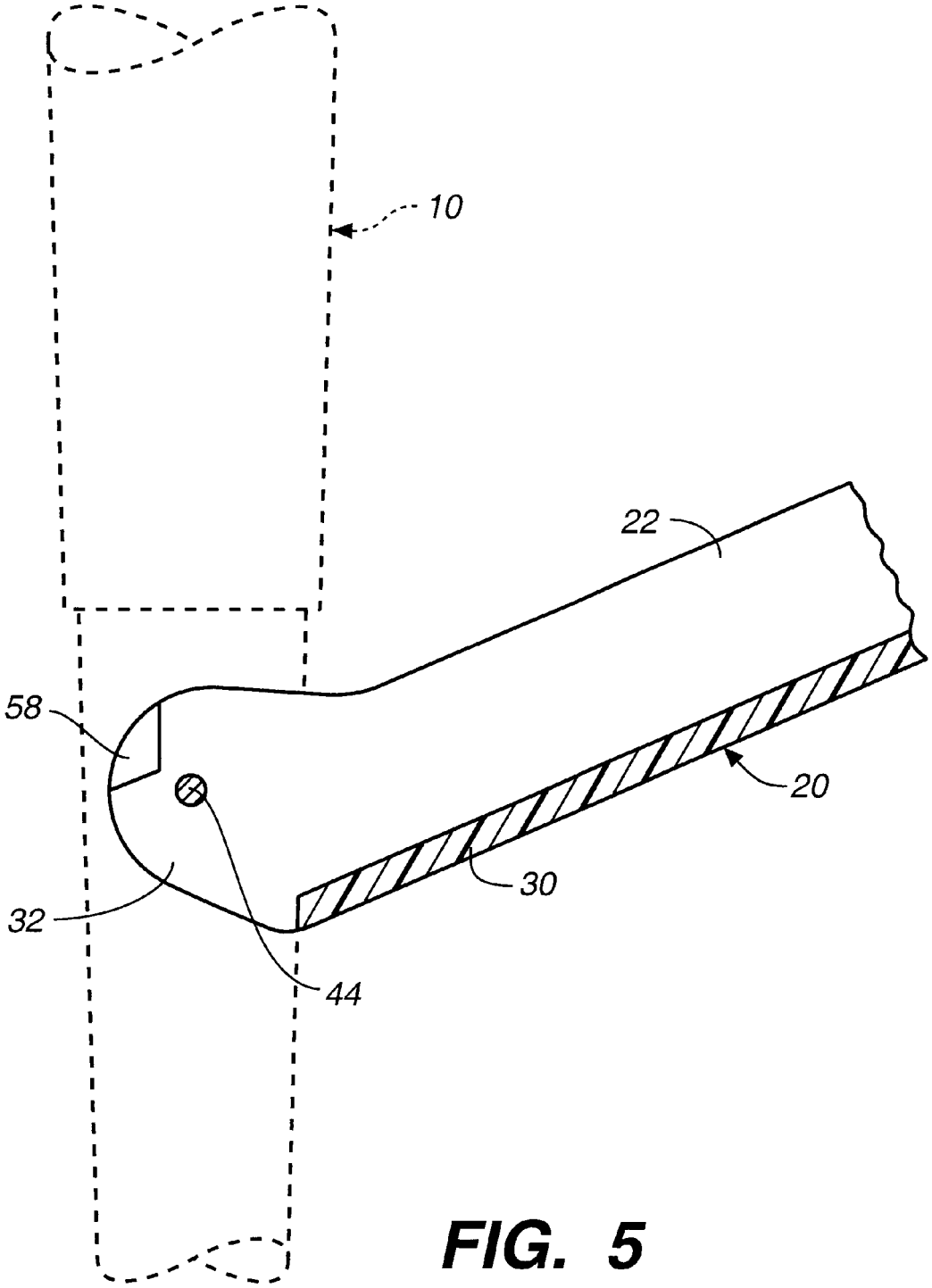
FIG. 5 is an elevational view illustrating a portion of the secondary support member in cross-section and associated with a portion of the primary support member, the latter being shown in dash lines.
Figure 6:
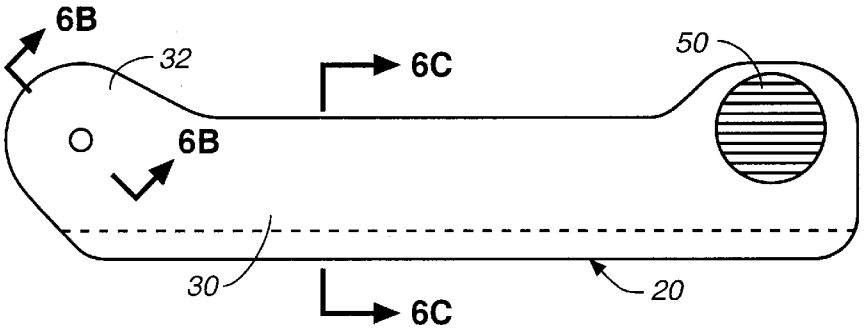
FIG. 6 is a side elevational view of the secondary support member.
Figure 6B:
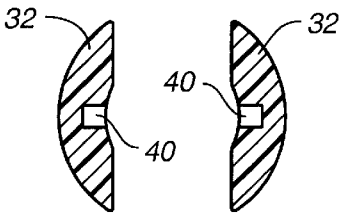
FIG. 6B is an enlarged, cross-sectional view taken along the line 6B—6B in FIG. 6.
Figure 6C:
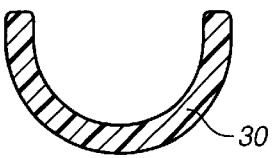
FIG. 6C is a cross-sectional view taken along line 6C—6C in FIG. 6.
Figure 6D:
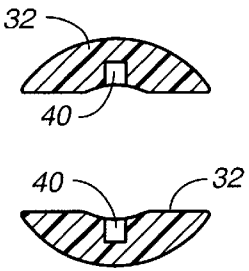
FIG. 6D is a cross-sectional view taken along the line 6D—6D of FIG. 6A.
Figure 6E:
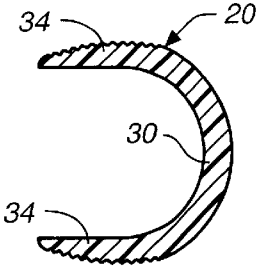
FIG. 6E is a cross-sectional view taken along the line 6E—6E in FIG. 6A.
Figure 6A:
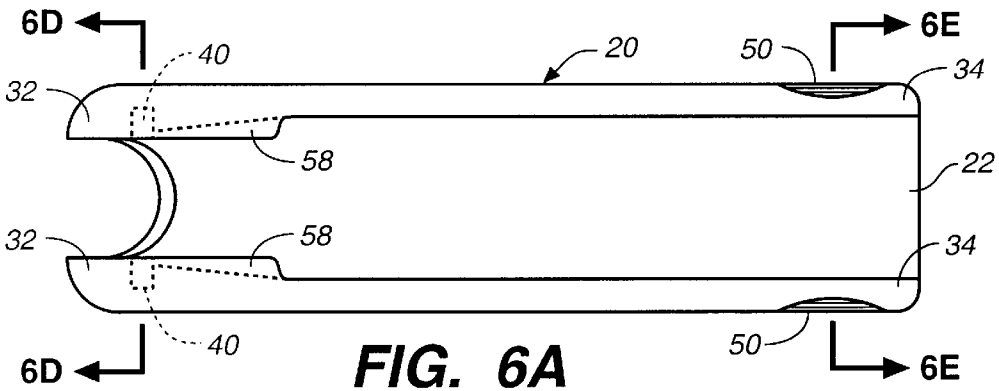
FIG. 6A is a top elevational view of the secondary support member.

The secondary support member is selectively pivotally movable relative to the primary support member between a first location (shown in FIG. 2C) and a second location (shown in FIGS. 1, 2B and 5).

When the secondary support member is in the first location it is disposed substantially parallel to the primary support member longitudinal axis and the primary support member is positioned in the secondary support member cavity 22. When in the second location thereof the secondary support member projects outwardly away from the primary support member and forms an acute angle with the primary support member longitudinal axis. Furthermore, when the secondary support member is in the second location it defines along with the primary support member an upwardly open V-shaped notch therebetween for receiving golf club shafts. FIG. 1 shows two clubs 24, 26 disposed in a generally upright or vertical condition with the shafts thereof positioned in the V-shaped notch. Gravity will cause the club shafts to be retained in the notch between the primary support member and secondary support member.

The secondary support member is suitably integrally formed of molded reinforced plastic although other suitable materials could be utilized in this construction. The secondary support member includes a double-ended curved body 30 of generally semi-cylindrical configuration and first and second pairs of projections attached to the double-ended curved body. The projections of one of the pairs of projections are designated by reference numeral 32 and the projections of the other pair of projections are designated by reference numeral 34.

Projections 32 are attached to one end of the curved body 30 and the projections 34 are attached to the other end of the curved body. The projections of each pair of projections are spaced from one another and project outwardly from the double-ended curved body 30.

Sockets 40 are formed in projections 32 and these sockets receive pins 44 projecting from opposed sides of the primary support member 10 near the upper end thereof. Alternatively, a single pin could pass through primary support member 10 with the pin ends projecting from opposed sides. In the arrangement illustrated the upper end of the primary support member is in the form of a handle and the pins 44 are disposed just below the lower end of the handle. Slots 46 may extend between the sockets 40 and the outermost extent of projections 32 to facilitate positioning of the pins in the sockets between the primary support member and secondary support member when the support members are connected together or during removal of the secondary support member from the primary support member. There are no protruding screws or rivets which could scratch paint on graphite shafts or damage grips or other equipment. Roughened indents 50 may be provided on the outer surfaces of projections 34 so that a golfer can readily grasp the secondary support member to pivot it relative to the primary support member. The projections 32 preferably have some degree of flexibility to facilitate these operations also.

Raised retention members 58 are affixed to the inner surfaces of projections 32 and these retention members engage the primary support member 10 to either releasably retain the secondary support member at the first location or the second location, depending upon which side of the primary support member the retention members 58 are located. That is, the retention members 58 are in opposition to one another and provide a clearance less than the diameter of the primary support member where the retention members engage the support member. This, in effect, provides a "snap" action which will tend to keep the secondary support member in either the first location or the second location; it being understood, of course, that sufficient manual pressure exerted on the secondary support member by the golfer will bring the secondary support member to the desired location or position.

The curved body 30 of the secondary support member has a curved end 60 which communicates with the cavity 22 and engages the primary support member when the secondary support member is in its second location to maintain the secondary support member at a fixed angle relative to the primary support member.

Figure 7:
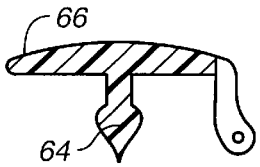
FIG. 7 is a cross-sectional, elevational view of an end cap and article holder element employed in the golf club support apparatus.
Figure 2C:
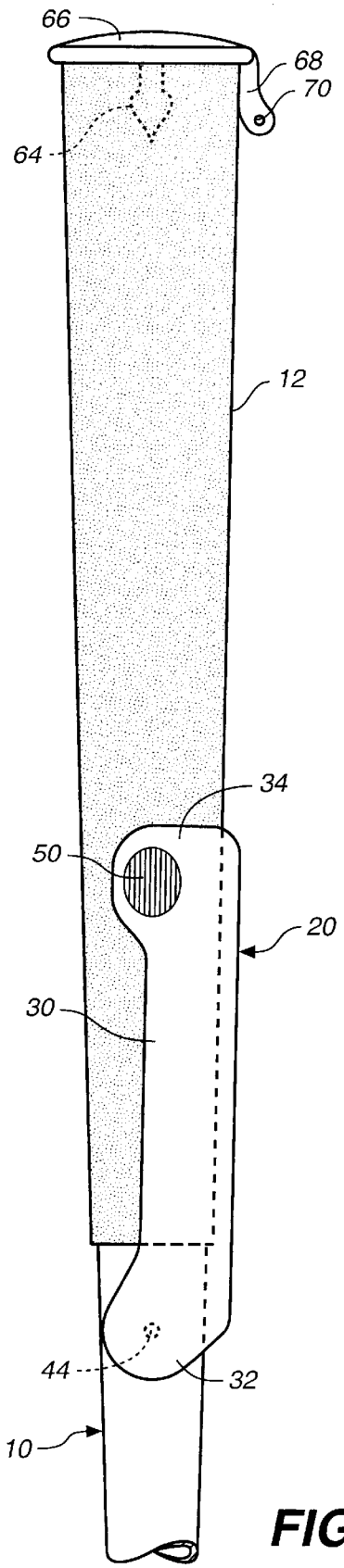
FIG. 2C is an enlarged, elevational view illustrating the upper end portion of the primary support member and the secondary support member disposed at another location wherein the secondary support member is substantially parallel to the primary support member longitudinal axis.

Referring now to FIGS. 2B and 7, the illustrated embodiment of the golf club support apparatus incorporates a handle which has an aperture 62 at the top thereof. Aperture 62 releasably retains therein a connector 64 projecting downwardly from an end cap 66. FIG. 2C shows end cap 66 in place on the handle. An article holder element 68 having a hole 70 is affixed to the end cap. The holder element may be used in any suitable fashion to hold an article in place. FIG. 1, for example, illustrates a towel 72 clipped to and suspending from the article holder element.

The invention claimed is:

1. Golf club support apparatus comprising, in combination:

a double-ended, elongated, rigid primary support member having an upper end, a ground engaging lower end, and a primary support member longitudinal axis extending between said upper end and said ground engaging lower end, said ground engaging lower end for insertion into the ground to maintain the double-ended, elongated, rigid primary support member at a selected orientation relative to the ground and said upper end disposed above the ground;

a secondary support member pivotally attached to said double-ended, elongated, rigid primary support member and defining a secondary support member cavity extending the length of said secondary support member, said secondary support member being selectively pivotally movable relative to said double-ended, elongated, rigid primary support member between a first location wherein said secondary support member is disposed substantially parallel to said primary support member longitudinal axis and a portion of said double-ended, elongated, rigid primary support member is positioned in said secondary support member cavity and partially surrounded thereby and a second location wherein said secondary support member projects outwardly away from said double-ended, elongated, rigid primary support member, said secondary support member comprising a double-ended curved body of generally semi-cylindrical configuration and first and second pairs of projections attached to said double-ended curved body, the first pair of projections attached at one end of said double-ended curved body and the second pair of projections attached to the other end of said double-ended curved body, the projections of each pair of projections being spaced from one another and protecting outwardly from said double-ended curved body, said double-ended, elongated, rigid primary support member and said secondary support member being pivotally attached by a pin and socket interconnection at said first pair of projections; and at least one retention member connected to at least one of said first pair of projections for engaging said double-ended, elongated, rigid primary support member to releasably retain said secondary support member against movement relative to said double-ended, elongated, rigid primary support member, and said secondary support member defining an acute angle with said primary support member longitudinal axis when said secondary support member is in said second location.

2. The golf club support apparatus according to claim 1 wherein said pin and socket interconnection is located closer to the upper end of said double-ended, elongated, rigid primary support member than to the ground engaging lower end thereof.

3. The golf club support apparatus according to claim 1 wherein said double-ended, elongated, rigid primary support member and said secondary support member define an upwardly open V-shaped notch therebetween for receiving golf club shafts when said secondary support member is in said second location.

4. The golf club support apparatus according to claim 3 wherein said secondary support member includes a primary support member engagement surface for engaging said double-ended, elongated, rigid primary support member when said secondary support member is in said second location to maintain said secondary support member in said second location.

5. The golf club support apparatus according to claim 4 wherein said curved body has a curved end comprising said primary support member engagement surface, said curved end communicating with said secondary support member cavity.

6. The golf club support apparatus according to claim 1 wherein at least one of said projections flexes upon application of outside forces thereto.

7. The golf club support apparatus according to claim 1 additionally comprising an end cap removably connected to the upper end of said double-ended, elongated, rigid primary support member and an article holder element attached to said end cap.

8. The golf club support apparatus according to claim 7 wherein said upper end comprises a handle and wherein said golf club support apparatus includes releasable connector means for releasably connecting said end cap to said handle.

9. The golf club support apparatus according to claim 1 wherein said secondary support member is of integral molded plastic construction.

10. The golf club support apparatus according to claim 1 wherein the ground engaging lower end is tapered and rounded at the extremity thereof.

11. The golf club support apparatus according to claim 1 wherein the other of the projections of said first pair of projections has a retention member attached thereto in opposition to said at least one retention member, said retention members engageable with said double-ended, elongated, rigid support member to selectively releasably retain said secondary support member at one of said first location and said second location.

* * * * *